US005384199A

United States Patent [19]

Carlson et al.

[11] Patent Number: 5,384,199

[45] Date of Patent: Jan. 24, 1995

[54] CARBON PAPER AND METHOD FOR MAKING SAME

[75] Inventors: Gene D. Carlson, Crocker Township, Polk County, Iowa; Alfredo R. Dela Cruz, Alpharetta, Ga.

[73] Assignee: Frye Copystystems, Inc., Des Moines, Iowa

[21] Appl. No.: 34,135

[22] Filed: Mar. 22, 1993

[51] Int. Cl.[6] ..... B41M 5/10

[52] U.S. Cl. ..... 428/488.1; 428/484; 428/486; 428/511; 428/537.5

[58] Field of Search ..... 428/488.1, 195, 207, 428/211, 537.5, 484, 486, 511; 427/153, 146

[56] References Cited

U.S. PATENT DOCUMENTS

| | | | |
|---|---|---|---|
| 2,357,948 | 9/1944 | Gessler et al. | 106/31 |
| 2,824,815 | 2/1958 | Downs et al. | 117/36 |
| 2,866,711 | 12/1958 | Hart | 106/22 |
| 3,653,958 | 4/1972 | Kohn et al. | 427/442 |
| 4,327,128 | 4/1982 | Thurlow | 427/153 |
| 4,352,855 | 10/1982 | Hiraishi et al. | 428/211 |
| 4,572,860 | 2/1986 | Nakamura et al. | 428/216 |
| 4,643,917 | 2/1987 | Koshizuka et al. | 427/256 |
| 5,106,694 | 4/1992 | Mizobuchi et al. | 428/447 |

*Primary Examiner*—Patrick J. Ryan
*Assistant Examiner*—Marie R. Macholl
*Attorney, Agent, or Firm*—Zarley, McKee, Thomte, Voorhees & Sease

[57] ABSTRACT

A carbon paper includes a film of carbon based hot melt ink coated on one side of a flat sheet of paper. The carbon based hot melt ink includes carbon black and a stearate.

9 Claims, No Drawings

CARBON PAPER AND METHOD FOR MAKING SAME

BACKGROUND OF THE INVENTION

The present invention relates to carbon paper, specifically a carbonized bond paper and a method for making same.

Prior art carbon paper has several disadvantages. The carbon ink on the carbon paper smudges easily and comes off on the user's hands during use. Also prior art carbon paper is difficult to run through a printing press because the sticky carbon ink comes off on the rollers of the printer, and often causes a tear in the paper web being run through the printer.

Therefore a primary object of the present invention is the provision of an improved carbon paper, and a method for using same.

A further object of the present invention is the provision of carbon paper having a carbon ink which does not smudge or come off on the user's hands or on a printer roller.

A further object of the present invention is the provision of an improved ink for use on carbon paper which is slippery so that it does not build up on printer rollers when being passed through a printing press.

A further object of the present invention is the provision of an improved ink for use on carbon paper which does not smudge, which has a slippery consistency, and which copies as well as prior art carbon paper.

A further object of the present invention is the provision of a carbon paper and method for making same which is economical in manufacture, durable in use, and efficient in operation.

SUMMARY OF THE INVENTION

The foregoing objects may be obtained by the use of a hot melt carbon based ink comprising carbon black and a stearate (or an ester of stearic acid or a solid form amide). The preferred stearate is a liquid butyl stearate manufactured by Humko Chemical Company, Memphis, Tenn. under the trade designation Kemester 5510. Solid form amides can also be used and examples of these are manufactured by Humko Chemical Company under the trade designations Kemamide U and Kemamide S. Any $C_1$ to $C_8$, preferably $C_1$ to $C_4$ alkyl stearate may be employed. Solid form esters of stearic acid and solid form amides such as $C_{12}$ to $C_{18}$ primary amides, both saturated and unsaturated may also be used.

The carbon black and the stearate are ground together with various hot melt waxes such as montan wax, carnauba wax and fully refined paraffin wax. Mineral oil and mineral seal oil are also added. A filler such as kaolin clay can also be added to the mixture as well as titanium dioxide which provides a whitening agent so as to combine with the carbon black to provide the desired color. Various combinations of the above waxes, oils, clay and titanium dioxide can be used in combination with the butyl stearate and the carbon black to produce the desired hot melt ink.

After the ink has been prepared, and while it is heated, the ink is applied to the surface of paper or other sheet material. In its heated condition, the hot melt ink is liquid and after it is applied to the sheet material it is permitted to cool and harden. The resulting carbon paper has a carbon ink thereon which is slippery and which will not smudge and come off on the user's hands. However, it will transfer and produce images equally as well as prior art carbon paper.

One particular advantage of the present invention is that the carbon paper using the ink of the present invention can be printed on a printing press without causing a build up of carbon ink on the rollers of the printing press. The stearate in combination with the other materials of the ink produces a slippery and hard ink which will not come off on the rollers, and which therefore prevents tearing of the paper web in printing presses, a problem commonly encountered with prior art carbon paper. It is therefore easy to print the desired printed material on the paper carrying the carbon hot melt ink.

DETAILED DESCRIPTION OF THE PREFERRED EMBODIMENT

Below is an example of a preferred combination of materials for use in the hot melt ink for the present invention:

| Materials | % By Weight |
|---|---|
| Montan wax manufactured by Jackson Valley Energy Partners, Ione, California under the trade designation ALPCO 1650. | 10% |
| Butyl stearate in a liquid form manufactured by Humko Chemical Company, Memphis, Tenneessee under the trade designation Kemester 5510. | ½–5% |
| Mineral oil having a viscosity of between 70–120 seconds. | 20% |
| Fully refined paraffin wax having a melting point of from 140°–160° F. | 13% |
| Mineral seal oil.having a flash point of from 148°–170° F. | 5% |
| Carnauba wax filtered or centrifuged. | 25% |
| High grade carbon black having a tint characteristic of 130 and having a DBP of 60–70. | 2.5% |
| Titanium dioxide. | 17.5% |
| Kaolin clay. | 6% |

The above example will produce an ink having a viscosity from 18–30 seconds as measured on a Zahn Cup No. 2. The ink will have a hardness characteristic of from 6–20 dmm at 77° F., 50 gram weight, for 5 seconds. The ink will have a melt point of from 160°–170° F.

The above percentages may be varied without detracting from the invention. Below is a list of the various permissible ranges of percent by weight of each of the above materials:

| Materials | % By Weight |
|---|---|
| Montan Wax | 2–20% |
| Butyl Stearate | ½–5% |
| Mineral Oil | 10–25% |
| Paraffin Wax | 0–15% |
| Mineral Seal Oil | 0–10% |
| Carnauba Wax | 20–50% |
| High Grade Carbon Black | 2–25% |
| Titanium Dioxide | 0–20% |
| Kaolin Clay | 0–10% |

The above butyl stearate is preferred. However, any $C_1$ to $C_8$, preferably $C_1$ to $C_4$ alkyl stearate may be employed. Solid form esters of stearic acid and solid form amides such as $C_{12}$ to $C_{18}$ primary amides, both saturated and unsaturated, may be employed. The minimum ingredients essential to provide a working example of this hot melt carbon ink are: carbon black, a stearate (or the above described esters of stearic acid or solid form amides), and one or more of the above waxes preferably carnauba wax. The stearate imparts slipperiness and prevents smudging. The carbon imparts color, and releases to transfer images, and the wax enhances the ability of the carbon to release. The other waxes and oil may be added to enhance the release characteristics and to create the desired viscosity of the ink.

The ink in the above example is prepared in a shot mill in the following manner. The ingredients are added and are heated to between 190° F. and 220° F.

First the following materials are charged into the kettle of the shot mill: the montan wax, the carnauba wax, the mineral oil and the butyl stearate. The materials are ground at a high speed for approximately 15 minutes.

Next the carbon black, titanium dioxide, and kaolin clay are added to the shot mill. They are ground at high speed for 45 minutes to a fineness of grind of #6 Hegman.

Next the paraffin wax and the mineral seal oil are added to the kettle and are ground at a slow speed for approximately 15 minutes. The ink is now ready for coating and is placed in a holding tank for use in the printing process.

The printing is accomplished on 12–20 pound bond paper. The ink temperature is preferably between 195°–220° F. Paper is preheated by a preheat roller and is then applied by a roller in conventional fashion. A chill roller is used to cool the paper to approximately 37°–44° F. which causes the ink to solidify. Paper can be coated in this manner at a speed of approximately 400–1,200 feet per minute. The resulting ink weight is preferably 1.6–2.2 pounds per ream, with each ream having 500 pieces in a 20×30 inch dimension.

The paper resulting from the above process can be used as a carbon paper, and provides equally good imprint as does prior art carbon paper. However, the ink does not smudge when touched by the user. Furthermore, the paper having the ink thereon can be run through a conventional printing press, and the ink will not collect on the rollers of the printing press. Therefore the web tears commonly incurred when conventional carbon paper is used on a printing press do not occur with the paper of the present invention.

The mixing procedure described above utilizes a shot mill for mixing and grinding the ingredients. A ball mill can also be used as well as a sand mill to produce the grinding and preparation of the ink.

When a ball mill is used, the carnauba wax, montan wax, mineral oil, paraffin wax, butyl stearate, and mineral seal oil are added to mill and are ground for approximately 1 hour or until the waxes are completely melted. The steel shots or ceramic beads in the mill are maintained at a temperature of 190°–220° F.

Next the high-grade carbon black, the titanium dioxide, and the kaolin clay are added to the mixture and are ground for 3½ hours to a fineness grind of #6 Hegman. The ink is then ready for coating, and is placed in a holding tank and kept at a temperature of approximately 200° F.

When the sand mill is used, the grinding media is maintained at approximately 190°–220° F. The carnauba wax, montan wax, mineral oil, paraffin wax, and butyl stearate are added and are mixed at a high speed for 15 minutes or until the waxes are completely melted.

Next the high-grade carbon black, the titanium dioxide, and the kaolin clay are added and mixed at a high speed for 45 minutes. The temperature of the mix should be 210°–220° F.

Next the paraffin wax and the mineral seal oil are added and are mixed at a slow speed for 15 minutes. The mixture is then ready for sand mill dispersion. The sand mill is adjusted to create an ink flow which produces a fineness of grind of #6.

After the mixture has been dispersed through the sand, the ink is ready for coating and is transferred to a holding tank for storage.

In the specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

I claim:

1. In combination:

a carbon paper comprising a sheet of paper having opposite surfaces and a film of carbon based hot melt ink coated on at least one of said opposite flat surfaces of said sheet of paper;

said carbon based hot melt ink comprising a wax material, carbon black, and a third material selected from the group consisting essentially of liquid butyl stearate, $C_1$ to $C_8$ alkyl stearates, solid esters of stearic acid, and $C_{12}$ to $C_{18}$ saturated and unsaturated primary amides; said third material being present in a percentage of ½% to 5% by weight of said hot melt ink.

2. A combination according to claim 1 wherein said third material consists essentially of liquid butyl stearate.

3. A combination according to claim 1 wherein said wax material is selected from the group consisting essentially of montan wax, carnauba wax, and paraffin wax.

4. A combination according to claim 1 wherein said ink has a melt point between 160°–170° F.

5. A combination according to claim 1 wherein said ink has a hardness characteristic of from 6–20 dmm at 77° F., 50 gram weight, for 5 seconds.

6. A combination according to claim 1 wherein said ink has a melt point between 160°–170° F., and a hardness characteristic of from 6–20 dmm at 77° F., 50 gram weight, for 5 seconds.

7. A combination according to claim 1 wherein said wax material comprises the following in percentage by weight of said holt melt ink: 2–20% montan wax; 0–15% paraffin wax; and 20–50% carnauba wax.

8. A combination according to claim 7 wherein said hot melt ink further comprises the following in percentages by weight of said hot melt ink: 10–25% mineral oil; 0–10% mineral seal oil; 0–20% titanium dioxide, and 0–10% kaolin clay.

9. In combination:

a carbon paper comprising a sheet of paper having opposite surfaces and a film of carbon based hot melt ink coated on at least one of said opposite flat surfaces of said sheet of paper;

said carbon based hot melt ink comprising a wax material, carbon black, and a third material consisting essentially of a liquid butyl stearate, said third material being present in a percentage of ½% to 5% by weight of said hot melt ink.

* * * * *